US009742106B2

(12) United States Patent
Kenison et al.

(10) Patent No.: US 9,742,106 B2
(45) Date of Patent: Aug. 22, 2017

(54) ELECTRICAL CONNECTION APPARATUS AND METHOD

(71) Applicant: Schlumberger Technology Corporation, Sugar Land, TX (US)

(72) Inventors: Michael Kenison, Richmond, TX (US); Richard Morrison, Sugar Land, TX (US); Vong Vongphakdy, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 14/913,964

(22) PCT Filed: Aug. 22, 2014

(86) PCT No.: PCT/US2014/052248
§ 371 (c)(1),
(2) Date: Feb. 23, 2016

(87) PCT Pub. No.: WO2015/027138
PCT Pub. Date: Feb. 26, 2015

(65) Prior Publication Data

US 2016/0359262 A1 Dec. 8, 2016

Related U.S. Application Data

(60) Provisional application No. 61/869,539, filed on Aug. 23, 2013.

(51) Int. Cl.
*H01R 13/533* (2006.01)
*H01R 13/523* (2006.01)
(Continued)

(52) U.S. Cl.
CPC ..... *H01R 13/533* (2013.01); *H01R 13/523* (2013.01); *H01R 13/622* (2013.01);
(Continued)

(58) Field of Classification Search
CPC ..... H01R 13/533
See application file for complete search history.

(56) References Cited

U.S. PATENT DOCUMENTS 5,820,416 A 10/1998 Carmichael
6,439,899 B1 * 8/2002 Muzslay ..... H01R 13/5216 439/108

(Continued)

FOREIGN PATENT DOCUMENTS

EP 1251598 A1 10/2002
WO 2015027138 A1 2/2015

OTHER PUBLICATIONS

International Search Report and the Written Opinion for International Application No. PCT/US2014/052248 dated Dec. 24, 2014.

*Primary Examiner* — James Harvey
(74) *Attorney, Agent, or Firm* — Michael L. Flynn; Jody Lynn DeStafanis; Robin Nava

(57) ABSTRACT

A technique facilitates mechanical and electrical connection between components. The components may be coupled mechanically by a threaded engagement and electrically by first and second electrical couplers. The first and second electrical couplers may each have a plurality of electrical contacts oriented for linear engagement. The electrical contacts of the second electrical coupler are mounted on a first portion of the second electrical coupler which is rotatably received by a second portion to enable linear engagement of the electrical contacts while rotating the components relative to each other to form the mechanical connection.

20 Claims, 3 Drawing Sheets

(51) Int. Cl.

| | |
|---|---|
| ***H01R 13/622*** | (2006.01) |
| ***H01R 13/64*** | (2006.01) |
| ***H01R 39/64*** | (2006.01) |
| *H01R 107/00* | (2006.01) |

(52) U.S. Cl.
CPC ..... *H01R 13/64* (2013.01); *H01R 39/64* (2013.01); *H01R 2107/00* (2013.01)

(56) References Cited

U.S. PATENT DOCUMENTS

| | | | | |
|---|---|---|---|---|
| 7,886,832 | B2 | 2/2011 | Partouche | |
| 2005/0070141 | A1 | 3/2005 | Dopf et al. | |
| 2008/0003894 | A1 | 1/2008 | Hall et al. | |
| 2009/0229817 | A1* | 9/2009 | Partouche | E21B 17/02 166/242.6 |
| 2016/0359262 | A1* | 12/2016 | Kenison | H01R 13/523 |

* cited by examiner 46
52
54
80
82
50
86
66
60
64
78
90
84
48
62
76
68
88
70
72

ELECTRICAL CONNECTION APPARATUS AND METHOD

CROSS-REFERENCE TO RELATED APPLICATIONS

The present document is based on and claims priority to U.S. Provisional Application Ser. No. 61/869,539, filed Aug. 23, 2013, which is incorporated herein by reference in its entirety.

BACKGROUND

In many types of well applications, various components are joined mechanically and electrically. For example, downhole tools may be segmented into various components, e.g. modules, which are connected in the field at the wellhead. In some applications, electrical connectors are used at the interface between the components to enable flow of electrical signals along the downhole tool string. The electrical connectors may comprise a non-rotating electrical connector, e.g. a split threaded ring connection, or a rotating electrical connection, e.g. a slip ring connection. However, existing connections can suffer from lack of adequate sealing, exposure to voltage across a connector due to power conductors, loosening of components due to the effects of shock and vibration, and/or other various detrimental effects.

SUMMARY

In general, a methodology and system are provided for facilitating a mechanical and electrical connection between components. The components may be coupled mechanically by a threaded engagement and electrically by an electrical coupling system having first and second electrical couplers. The first and second electrical couplers may each have a plurality of electrical contacts oriented for linear engagement. The electrical contacts of the second electrical coupler are mounted on a first portion of the second electrical coupler which is rotatably received by a second portion to enable linear engagement of the electrical contacts while rotating the components relative to each other to form the mechanical connection.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology able to facilitate transmission of electrical signals between a variety of components. Additionally, the technique facilitates simultaneous mechanical and electrical connections between components used in a variety of environments, including harsh, wellbore environments. According to an embodiment, components are coupled mechanically by a threaded engagement and electrically by an electrical coupling system having first and second electrical couplers. The first and second electrical couplers may each have a plurality of electrical contacts oriented for linear engagement while the components are rotated with respect to each other to enable the threaded, mechanical engagement.

In a specific example, two components are in the form of two pieces of oilfield equipment which are mechanically coupled by rotatable engagement. The components also share an electrical coupling system in the form of a sealed, rotating, spring-loaded electrical connection which is self-aligning for linear engagement of electrical contacts. The construction may further ensure that the electrical contacts are protected with respect to exposure to voltage from associated power sources, e.g. power cables.

Figure 1:
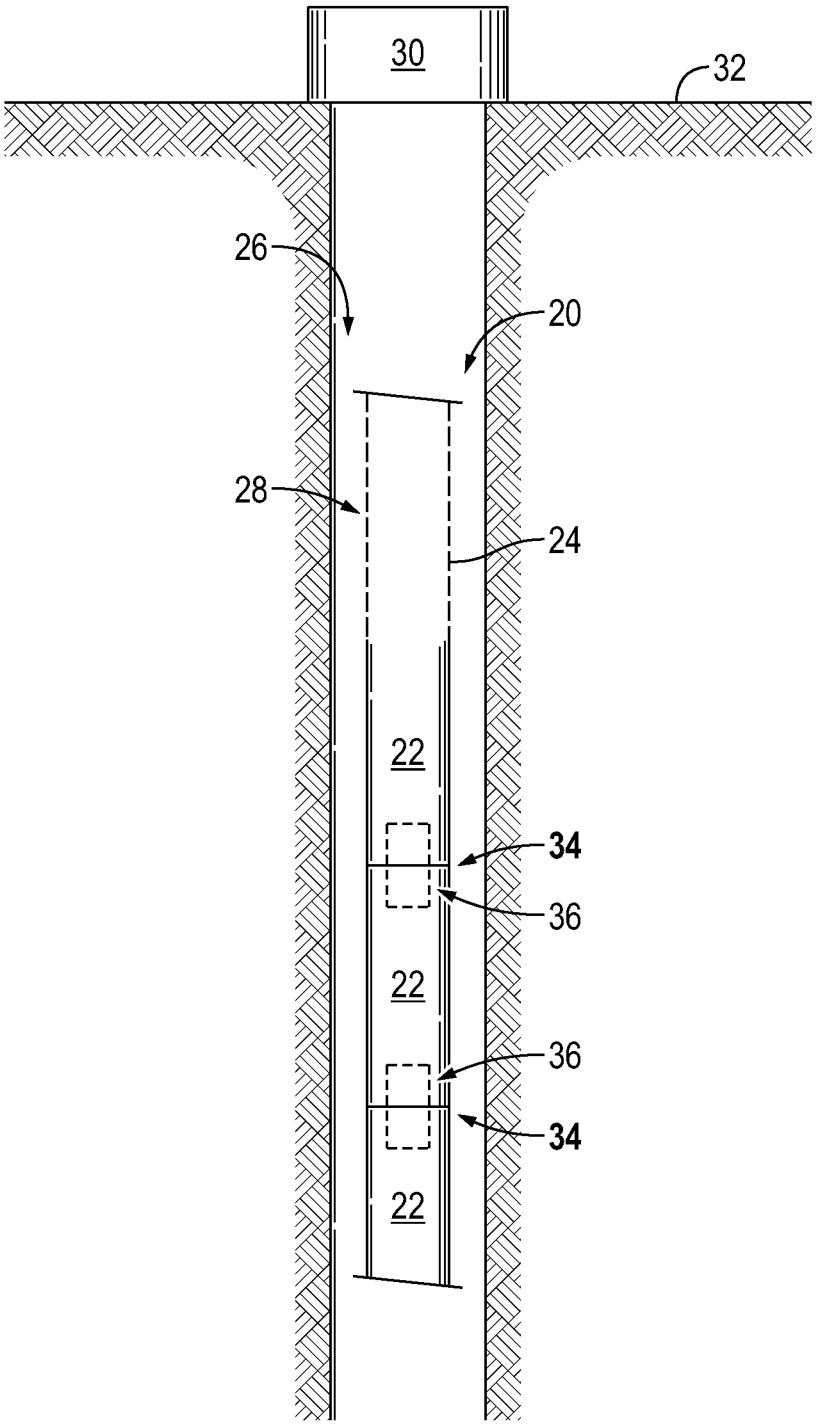
FIG. 1 is a schematic illustration of an example of components mechanically and electrically coupled to each other and deployed downhole in a borehole, according to an embodiment of the disclosure.

Referring generally to FIG. 1, an embodiment of a system 20 is illustrated as having a plurality of components 22 which are mechanically and electrically connected to each other. By way of example, the components 22 may comprise well components, e.g. well tools, which are mechanically and electrically connected along a well string 24 deployed downhole in a wellbore 26. In this type of embodiment, the components 22 may be deployed downhole via a suitable conveyance 28 extending down from surface equipment 30, e.g. a rig or wellhead, positioned at a surface location 32. As illustrated, adjacent components 22 may be mechanically connected by a mechanical coupling system 34 and electrically connected by an electrical coupling system 36. The mechanical coupling system 34 and electrical coupling system 36 may be used to connect a variety of components 22 for use in well applications and other, non-well applications.

Figure 2:
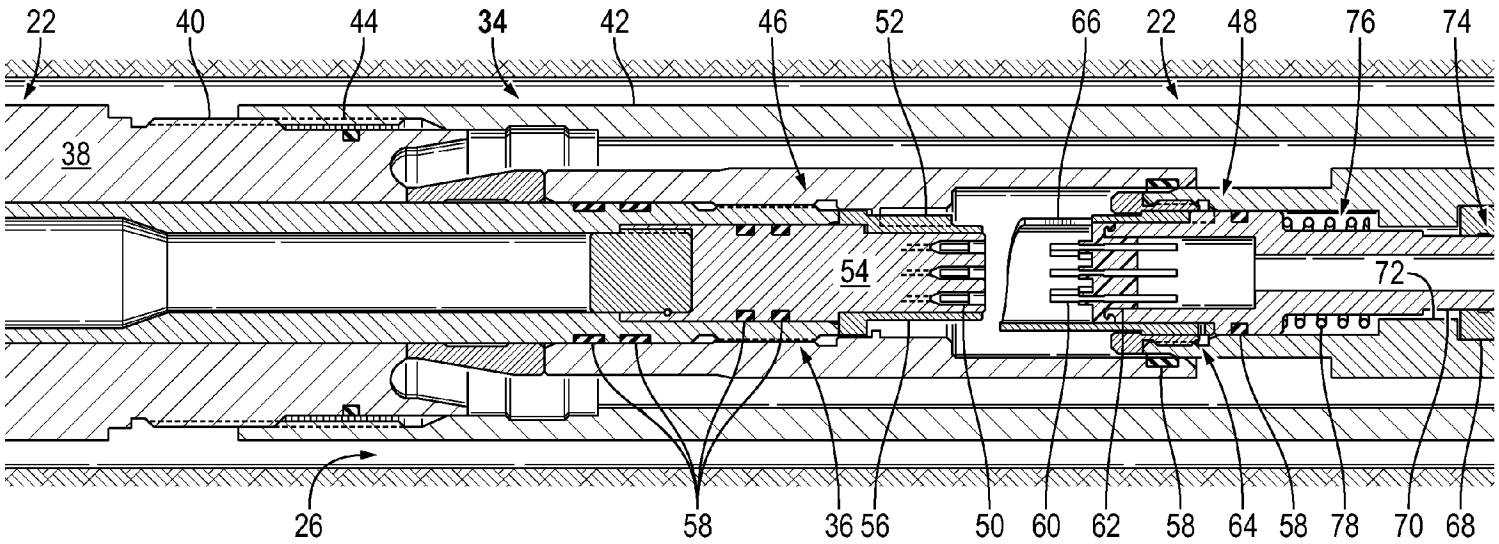
FIG. 2 is a cross-sectional view of an example of components mechanically and electrically coupled to each other via an embodiment of an electrical coupling system, according to an embodiment of the disclosure.

Referring generally to FIG. 2, an example of the combined mechanical coupling system 34 and electrical coupling system 36 is illustrated. In this example, the adjacent components 22 comprise outer housings which may be threadably engaged. For example, a first of the components 22 may comprise an external housing 38 having a threaded region 40. Similarly, a second of the components 22 may comprise an external housing 42 having a threaded region 44 for threaded engagement with corresponding threaded region 40.

In this example, the first component 22 further comprises an electrical coupler 46 and the adjacent, second component 22 comprises a corresponding electrical coupler 48. The electrical couplers 46, 48 form the electrical coupling system 36. In this embodiment, the first electrical coupler 46 comprises a plurality of electrical contacts 50 and an alignment device 52, e.g. a key. The electrical contacts 50 may be mounted in a bulkhead 54, e.g. a socket bulkhead, surrounded by a sleeve housing 56 to which the key 52 or other alignment device is mounted. A variety of seals 58 may be used between corresponding features, e.g. between bulkhead 54 and the surrounding housing(s), to seal off the electrical coupling system 36 from deleterious well fluids or other fluids.

The second electrical coupler 48 may comprise a plurality of corresponding electrical contacts 60 constructed for linear engagement with the electrical contacts 50. By way of example, electrical contacts 50, 60 may be plug-type contacts in which male or pin contacts, e.g. electrical contact 60, are received in corresponding female or socket contacts, e.g. electrical contacts 50. The electrical contacts 60 may be mounted in a bulkhead 62, e.g. a pin bulkhead. In this example, the second electrical coupler 48 comprises a male portion 64 having a corresponding alignment device 66, e.g. an alignment sleeve, which works in cooperation with the alignment device 52, e.g. the key. As the threaded region 40 of the first component 22 and the threaded region 44 of second component 22 are threaded together, the first electrical coupler 46 rotates relative to alignment sleeve 66 until key 52 engages alignment sleeve 66. At this stage, the alignment sleeve 66 and the key 52 work in cooperation to move electrical contacts 50 and corresponding electrical contacts 60 toward each other in a linear direction as threaded regions 40, 44 are threaded together. The linear movement of electrical contacts 50 and 60 toward each other is continued as threaded regions 40, 44 are threaded together until full engagement of electrical contacts 50 with electrical contacts 60. The alignment sleeve 66 restricts or blocks further relative rotational movement of coupler 46 with respect to sleeve 66 as the electrical contacts 50 and 60 are moved linearly toward each other during continued threading of threaded regions 40 and 44 to form the mechanical connection.

In many applications, the electrical contacts 50 and 60 are moved linearly toward each other via the relative rotation between first housing 38 and second housing 42 which effectively forms the threaded, mechanical connection of mechanical coupling system 34. To enable this continued relative rotation between housings 38, 42 once key 52 engages alignment sleeve 66, male portion 64 may be rotatably mounted in a corresponding female portion 68 of second electric coupler 48. By way of example, male portion 64 may comprise a stem 70 which extends into an interior 72 of female portion 68 and is rotatably mounted with respect to the female portion 68 via a rotatable connection 74. In the example illustrated, the male portion 64 also may move linearly with respect to female portion 68 over a predetermined distance. In some embodiments, a resilient member 76 is positioned between the male portion 64 and the female portion 68 to resist movement of stem 70 farther into interior 72. By way of example, the resilient member 76 may comprise a spring 78, e.g. a coiled spring positioned around stem 70.

In this example, the portions 64, 68 are described as male and female portions, respectively, however other engagement mechanisms may be used to provide a rotatable coupling between portion 64 and portion 68. Additionally, portion 68 may be constructed as the male portion and portion 64 may be constructed as the corresponding female portion. Regardless, a variety of seals 58 may again be used between corresponding features, e.g. between male portion 64 and female portion 68 and/or between female portion 68 and the surrounding housing features, to seal off the electrical coupling system 36 from deleterious well fluids or other fluids.

In an operational example, the threaded regions 40, 44 of adjacent components 22 are used to mechanically join the components 22 and to bring the electrical couplers 46, 48 together. As the first housing 38 and second housing 42 are threaded together, the adjacent components 22 move rotationally with respect to each other and linearly toward each other. During the initial stage of joining adjacent components 22, the bulkhead 54 of electrical coupler 46 rotates with respect to the corresponding bulkhead 62 of electric coupler 48. However linear alignment and engagement of electrical contacts 50 and 60 is accomplished via cooperation between alignment sleeve 66 and key 52.

Figures 3, 4, 5, 6, 7:
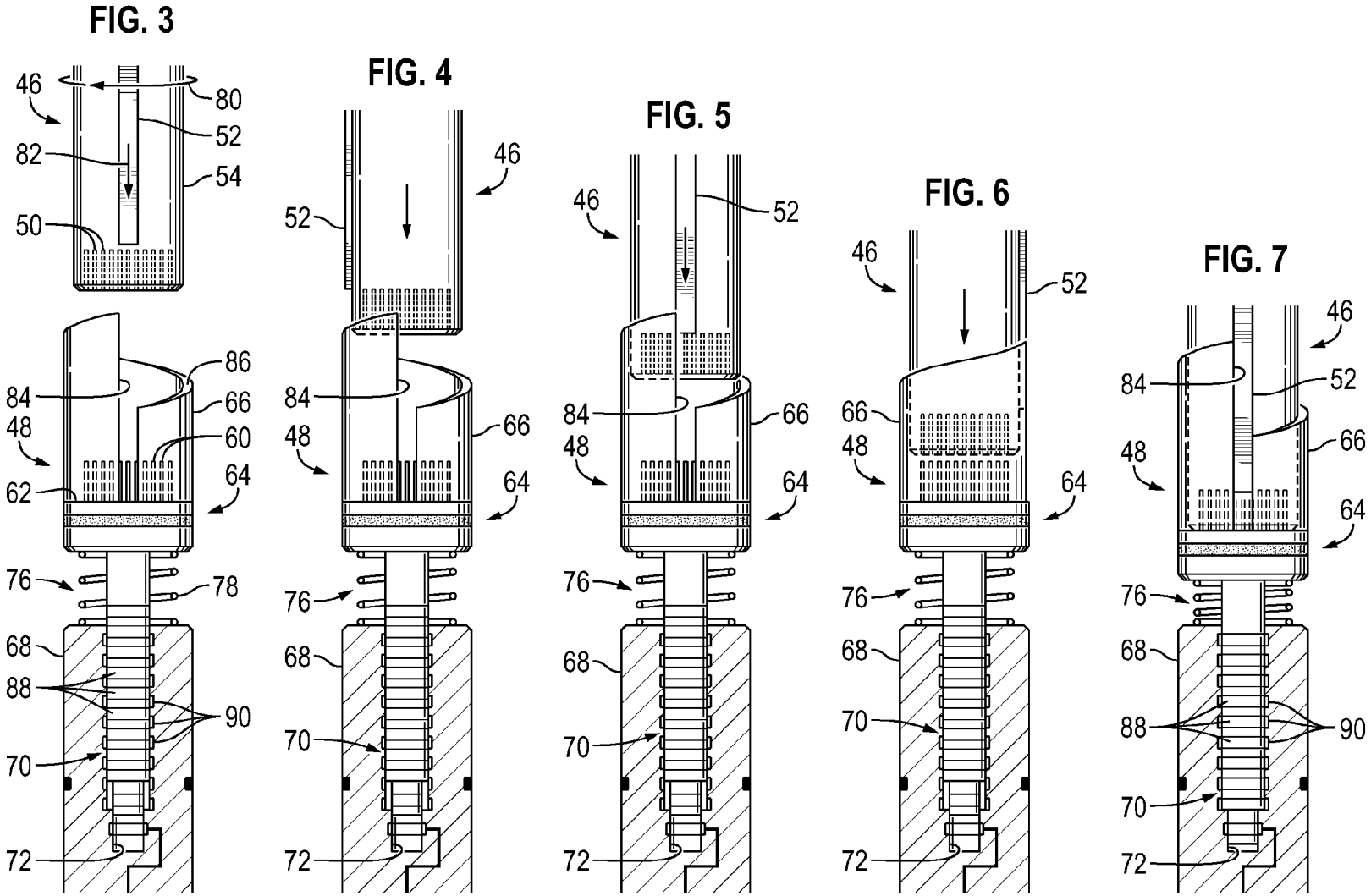
FIG. 3 is a schematic illustration of an example of the electric coupling system during an initial stage of coupling, according to an embodiment of the disclosure.
FIG. 4 is a schematic illustration of an example of the electric coupling system during a subsequent stage of coupling, according to an embodiment of the disclosure.
FIG. 5 is a schematic illustration of an example of the electric coupling system during a subsequent stage of coupling, according to an embodiment of the disclosure.
FIG. 6 is a schematic illustration of an example of the electric coupling system during a subsequent stage of coupling, according to an embodiment of the disclosure.
FIG. 7 is a schematic illustration of an example of the electric coupling system during a subsequent stage of coupling, according to an embodiment of the disclosure.

The alignment and engagement sequence of the electrical coupling system 36 is illustrated schematically in FIGS. 3-7. Referring initially to FIG. 3, the electrical coupler 46 rotates relative to corresponding electrical coupler 48, as indicated by arrow 80, during the initial stage of threadably engaging exterior housing 38 with corresponding exterior housing 42. During mechanical coupling, continued threading of corresponding threaded regions 40, 44 also causes linear or axial movement of electrical coupler 46 toward corresponding electrical coupler 48, as indicated by arrow 82.

Continued threading of exterior housing 38 into engagement with corresponding housing 42 causes bulkhead 54 to begin entering alignment sleeve 66, as illustrated in FIG. 4. However, the key 52 continues to miss engagement with alignment sleeve 66 until contacting an abutment surface 84 of alignment sleeve 66, as illustrated in FIG. 5. In this example, the alignment sleeve 66 comprises an outer edge 86 which has a pitch selected so as to prevent the key 52 from engaging the alignment sleeve 66 until completing another full revolution at threaded regions 40, 44, thus ensuring first contact with abutment surface 84.

The alignment sleeve 66 is a fixed component of portion 64 so once the key 52 engages abutment surface 84, as illustrated in FIG. 5, the portion 64 of electrical coupler 48 begins to turn with the bulkhead 54 of electrical coupler 46 relative to portion 68. For example, portion 64 may be a male portion in which stem 70 rotates with respect to female portion 68 along interior 72, as illustrated in FIG. 6. At this stage, the electrical coupler 46 rotates with male portion 64, but the electric coupler 46 also continues to move linearly with respect to male portion 64 along the interior of alignment sleeve 66. The linear motion of electrical coupler 46 with respect to portion 64 may be maintained by alignment sleeve 66 which restricts the key 52 to sliding linearly along abutment surface 84. The relative linear movement along the interior of alignment sleeve 66 continues until electrical contacts 50 are fully engaged with corresponding electrical contacts 60. In the example illustrated, the relative linear movement along the interior of alignment sleeve 66 is ultimately stopped when the lead face of bulkhead 54 reaches the corresponding face of bulkhead 62, as illustrated in FIG. 7.

After engagement of bulkhead 54 with bulkhead 62, continued threading of threaded region 40 with respect to threaded region 44 causes linear movement of both electrical coupler 46 and male portion 64 with respect to female portion 68. The linear movement of male portion 64 with respect to female portion 68 compresses resilient member 76 and inserts stem 70 farther along interior 72. In other words, the resilient member 76, e.g. spring 78, deflects under the make-up force of the main threads 40, 44 as the adjacent components 22 are fully mechanically engaged. In some embodiments, the resilient member 76 is not employed in the electrical coupling system. However, resilient member 76 may be used to help control the timing of the engagement of separate, stepped electrical contacts, e.g. stepped annular electrical contacts, as explained in greater detail below. In some applications, the resilient member 76 also may be helpful in reducing vibration.

Figure 8:
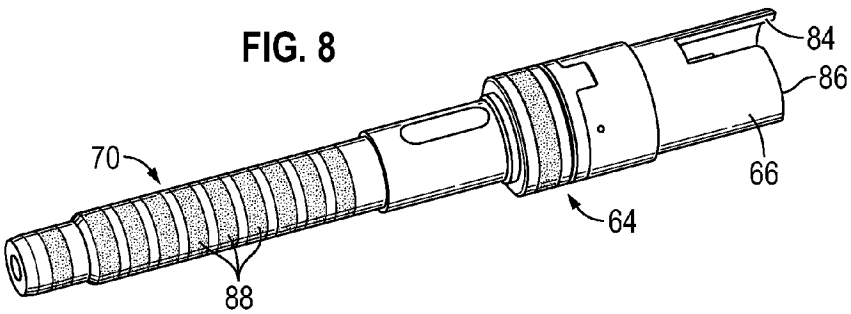
FIG. 8 is an illustration of an example of a male portion which may be used in the electric coupling system, according to an embodiment of the disclosure.

With additional reference to FIG. 8, the stem 70 may comprise a plurality of annular electrical contacts 88. The annular electrical contacts 88 are conductively connected with contacts 60, e.g. pin contacts. As the continued linear movement of electrical coupler 46 and male portion 64 compresses resilient member 76, the annular electrical contacts 88 are shifted into conductive contact with corresponding annular electrical contacts 90 disposed along the interior surface defining interior 72 (see FIG. 7). Connection of annular electrical contacts 88 and corresponding annular electrical contacts 90 enables the conduction of electric signals between male portion 64 and female portion 68, and thus through the electrical coupling system 36 for communication of electrical signals between adjacent components 22.

In some embodiments, the annular electrical contacts 88 are restricted from engaging corresponding annular electrical contacts 90 via resilient member 76 until the resilient member 76 is compressed a predetermined amount. In other words, the sequence for engaging electrical contacts 88, 90 may be stepped so as to limit the potential for damage when the electrical contacts 88, 90 are exposed to an electrical power source. In some applications, the connection between electrical contacts 88 and corresponding electrical contacts 90 may employ distances that can be timed and/or selected so the electrical connection is not made until the resilient member 76 compresses to a predetermined height, e.g. the height illustrated in FIG. 7. Thus, resilient member 76 helps provide a stepwise or stepped engagement of annular electrical contacts 88 and 90 by initially resisting engagement and then allowing engagement once the resilient member 76 is sufficiently compressed. The electrical engagement also may be restricted via, for example, an interference fit which is overcome by a predetermined force. Formation of the electrical connection according to a predetermined spring compression height may be useful if the stepped connection, e.g. a stepped connection between contacts 88, 90, is exposed to an electrical power source. In many applications, it may be undesirable to have exposed power on the electrical contacts 88 and/or 90 when assembling components 22 at, for example, a wellhead.

As described herein, the overall system 20 may comprise many types of components 22 for use in wellbores or other subterranean applications. For example, the components 22 may be utilized as components of a downhole tool assembly, a wellbore bottom hole assembly, or other downhole assemblies. However, system 20 also may comprise components 22 constructed for use in many types of surface applications and non-well related applications in which components are mechanically and electrically coupled together. In these various applications, the unique coupling system enables adjacent components 22 to be mechanically coupled through rotational, threaded engagement while simultaneously electrically connecting the adjacent components 22 through an electrical coupling system which undergoes both relative rotational motion and relative linear motion to facilitate the electrical connection.

Additionally, the mechanical coupling system 34 may comprise various types of threads, threaded housings, and/or other cooperating structural features between adjacent components 22. Similarly, the electrical coupling system 36 may comprise many types of components having a variety of configurations. For example, many types of bulkheads, internal housings, seals, electrical contacts, rotational connections, resilient members, and/or other components may have various sizes, configurations, and materials depending on the parameters of a given application.

A variety of first electrical couplers and corresponding second electrical couplers may be constructed for the cooperating rotational and linear motion employed to form the electrical connection. The portions 64 and 68 of the second electrical coupler 48 may utilize stems 70 with annular electrical contacts or other types of components which may rotate relative to each other while enabling flow of electrical current across the components. Similarly, many types of alignment devices 52, 66 may be used to facilitate linear engagement of various types of electrical contacts 50, 60. The alignment devices may comprise keys, sleeves, and/or other suitable devices for aligning the electrical contacts. Additionally, the key and the alignment sleeve may be swapped with respect to the electrical couplers 46 and 48. The electrical coupling system may be used between a pair of components or in conjunction with the mechanical, threaded connection of multiple components in a tool string or other type of system.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for forming an electrical connection, comprising:

a first component having a first external housing, a first threaded region on the first external housing, and a first electrical coupler disposed within the first external housing, the first electrical coupler having:

a plurality of first electrical contacts; and an alignment device;

a second component having a second external housing, a second threaded region on the second external housing, and a second electrical coupler disposed within the second external housing, the second electrical coupler having:

a female portion; and a male portion comprising a stem movably received in the female portion; a corresponding alignment device positioned to engage the alignment device when the second threaded region and the first threaded region are threaded together; and a plurality of second electrical contacts, wherein the alignment device and the corresponding alignment device cause rotation between the male portion and the female portion as the first and second threaded regions are threaded together so as to move the plurality of first electrical contacts linearly into engagement with the plurality of second electrical contacts.

2. The system as recited in claim 1, wherein the alignment device comprises a key and the corresponding alignment device comprises an alignment sleeve.

3. The system as recited in claim 1, further comprising a resilient member which is compressible between the female portion and the male portion.

4. The system as recited in claim 3, wherein the resilient member comprises a coil spring.

5. The system as recited in claim 1, wherein first component comprises a downhole well component.

6. The system as recited in claim 5, wherein the second component comprises a downhole well component.

7. The system as recited in claim 1, wherein the stem comprises a plurality of annular electrical contacts to conduct electrical signals between the male portion and the female portion.

8. The system as recited in claim 2, wherein the alignment sleeve comprises an abutment surface oriented to engage the key and an outer edge with a pitch selected to ensure the key engages the abutment surface.

9. The system as recited in claim 3, wherein the male portion has annular electrical contacts and the female portion has corresponding annular electrical contacts, the resilient member being used to provide a stepped engagement of the annular electrical contacts with the corresponding annular electrical contacts.

10. A method, comprising:

mechanically connecting a first component to a second component by threadably engaging outer housings of the first and second component; and forming an electrical coupling within the outer housings while threadably engaging the outer housings, the forming comprising:

linearly engaging a first electrical coupler of the first component with a first portion of a second electrical coupler of the second component while allowing the first portion to rotate with respect to a second portion of the second electrical coupler.

11. The method as recited in claim 10, wherein mechanically connecting comprises threadably engaging a first well component with a second well component.

12. The method as recited in claim 10, further comprising locating a resilient member between the first portion and a second portion of the second electrical coupler.

13. The method as recited in claim 10, wherein linearly engaging comprises restraining the first electrical coupler to linear movement with respect to the first portion of the second electrical coupler via a key and an alignment sleeve.

14. The method as recited in claim 10, wherein linearly engaging comprises inserting a plurality of electrical contacts linearly into engagement with a plurality of corresponding electrical contacts.

15. The method as recited in claim 12, further comprising compressing the resilient member to enable a stepwise electrical engagement between annular electrical contacts.

16. The method as recited in claim 13, wherein restraining comprises stopping relative rotation between the first electrical coupler and the first portion of the second electrical coupler by engaging the key with an abutment surface of the alignment sleeve.

17. A system, comprising:

an electrical coupling system having:

a first electrical coupler with a plurality of first electrical contacts;

a second electrical coupler having a plurality of second electrical contacts oriented for linear engagement with the plurality of first electrical contacts, the plurality of second electrical contacts being mounted on a first portion of the second electrical coupler which is rotatably received in a second portion of the second electrical coupler.

18. The system as recited in claim 17, wherein the first electrical coupler is mounted within a first wellbore component and the second electrical couplers mounted in a second wellbore component, the first and second wellbore components being threadably engaged.

19. The system as recited in claim 18, wherein the first electrical coupler is restricted to linear movement with respect to the first portion of the second electrical coupler during threaded engagement of the first wellbore component with the second wellbore component.

20. The system as recited in claim 19, wherein the first portion moves linearly with respect to the second portion during threaded engagement of the first wellbore component with the second wellbore component.

* * * * *